US007014337B2

(12) United States Patent
Chen

(10) Patent No.: US 7,014,337 B2
(45) Date of Patent: Mar. 21, 2006

(54) LIGHT DEVICE HAVING CHANGEABLE LIGHT MEMBERS

(76) Inventor: Chia Yi Chen, No. 4, Sinsheng 3rd Road, Donggang Township, Pingtung County (TW) 928

( * ) Notice: Subject to any disclaimer, the term of this patent is extended or adjusted under 35 U.S.C. 154(b) by 118 days.

(21) Appl. No.: 10/770,033

(22) Filed: Feb. 2, 2004

(65) Prior Publication Data

US 2005/0168985 A1 Aug. 4, 2005

(51) Int. Cl.
*F21V 1/00* (2006.01)

(52) U.S. Cl. ..... 362/240; 362/241; 362/247; 362/800

(58) Field of Classification Search ..... 362/241, 362/247, 545, 249, 238, 800
See application file for complete search history.

(56) References Cited

U.S. PATENT DOCUMENTS 1,074,537 A * 9/1913 Abeles ..... 362/544
5,103,382 A * 4/1992 Kondo et al. ..... 362/503
5,651,636 A * 7/1997 Yeh ..... 404/9
5,950,340 A * 9/1999 Woo ..... 40/564
6,132,072 A * 10/2000 Turnbull et al. ..... 362/494
6,481,130 B1 * 11/2002 Wu ..... 40/546
6,619,824 B1 * 9/2003 Hou ..... 362/501
6,641,294 B1 * 11/2003 Lefebvre ..... 362/544
2003/0174517 A1 * 9/2003 Kiraly et al. ..... 362/555

* cited by examiner

*Primary Examiner*—Sandra O'Shea
*Assistant Examiner*—Gunyoung T. Lee
(74) *Attorney, Agent, or Firm*—Charles E. Baxley

(57) ABSTRACT

A light device includes a housing having one or more chambers each formed between two flaps, one or more circuit boards received in the chambers of the housing, and a number of LED light members attached to the circuit boards to emit lights. The flaps of the housing may be used to concentrate or to reflect the lights emitted by the light members. The circuit board may be disengaged from the housing for being replaced with the other circuit board having new or good light members, when the old light members have been damaged or burned out.

7 Claims, 4 Drawing Sheets

LIGHT DEVICE HAVING CHANGEABLE LIGHT MEMBERS

BACKGROUND OF THE INVENTION

1. Field of the Invention

The present invention relates to a light device, and more particularly to a light device having a number of light members, such as light emitting diodes (LED) that may be easily changed or replaced with the other ones when required.

2. Description of the Prior Art

Various kinds of typical light devices have been developed and comprise a number of light members, such as light emitting diodes (LED) for generating indicating or warning lights.

Normally, the LED light members are directly and solidly attached to the circuit boards, and may not be disengaged from the circuit boards and may not be easily changed or replaced with the other ones, such that the whole light devices should be discarded away when some of the LED light members have been damaged.

In addition, the typical light devices do not have or provide any light concentrating or reflecting structure for the typical LED light members, such that the lights generated by the LED light members may not be suitably reflected or concentrated and may be dispersed.

The present invention has arisen to mitigate and/or obviate the afore-described disadvantages of the conventional light devices.

SUMMARY OF THE INVENTION

The primary objective of the present invention is to provide a light device including a number of light members, such as light emitting diodes (LED) that may be easily changed or replaced with the other ones when required.

The other objective of the present invention is to provide a light device including a light concentrating structure for reflecting or concentrating the lights generated by the LED light members.

The further objective of the present invention is to provide a light device including a number of light members each having a head or a lens for light dispersing purposes.

In accordance with one aspect of the invention, there is provided a light device comprising a housing including at least one chamber formed therein and defined between two flaps, at least one circuit board received in the chamber of the housing, and a plurality of LED light members attached to the circuit board, to emit lights. The flaps of the housing are provided to concentrate or to reflect the lights emitted by the light members. The circuit board may be disengaged from the housing for exchanging or replacing with the other circuit board having new or good light members attached thereon, when the old light members have been damaged or burned out.

The housing includes at least one flange extended into the chamber thereof, to engage with and to retain the circuit board in the chamber of the housing. The housing includes a channel formed by the flange, to receive the circuit board.

The housing includes a frame, and at least one casing secured to the frame and having the chamber formed therein and having the flaps extended therefrom. The frame includes a slot formed therein, the casing includes a projection extended therefrom and engaged into the slot of the frame, to attach the casing to the frame.

One or more fasteners may further be provided and engaged through the circuit board, to secure the circuit board to the casing. Each of the light members includes a lens attached thereon. Each of the light members includes a flat outer surface formed thereon for attaching the lens.

A receptacle may further be provided and includes a base panel to support the housing. The housing includes a cap attached thereon, and a plurality of LED light members attached to the cap to emit lights. The housing includes a hood attached onto the base panel, to cover and shield the housing and the light members.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 2:
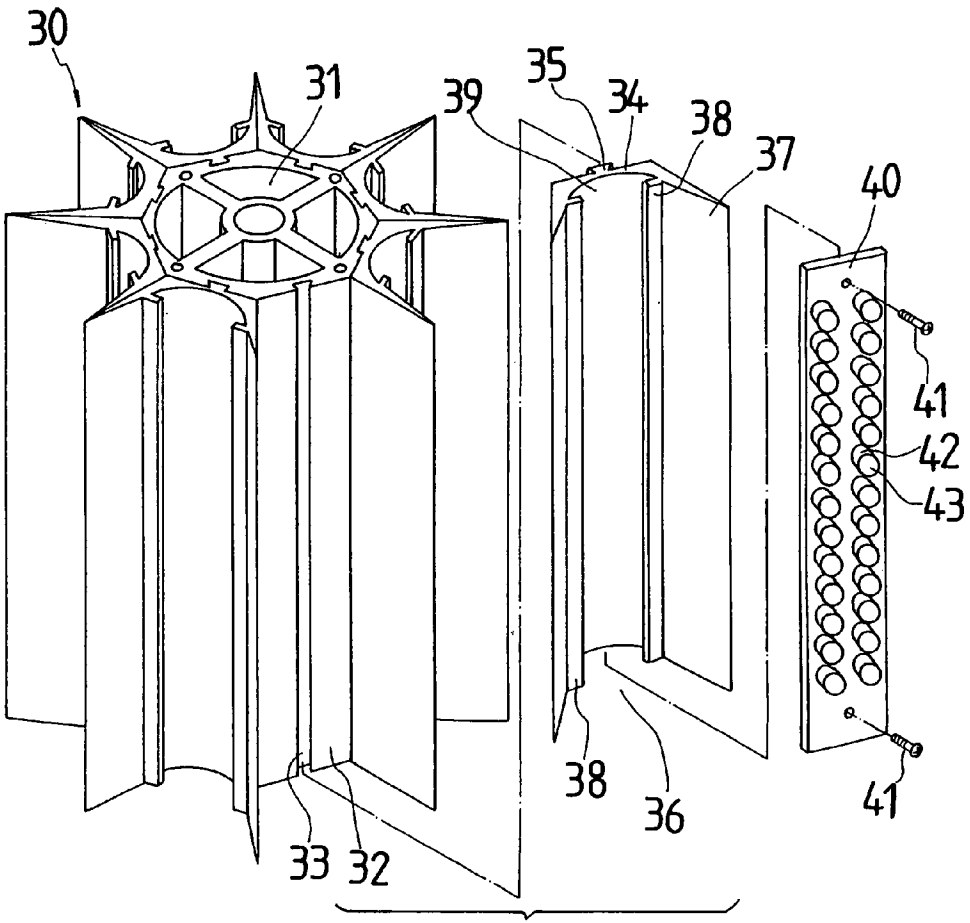
FIG. 2 is a partial exploded view of the light device.
Figure 1:
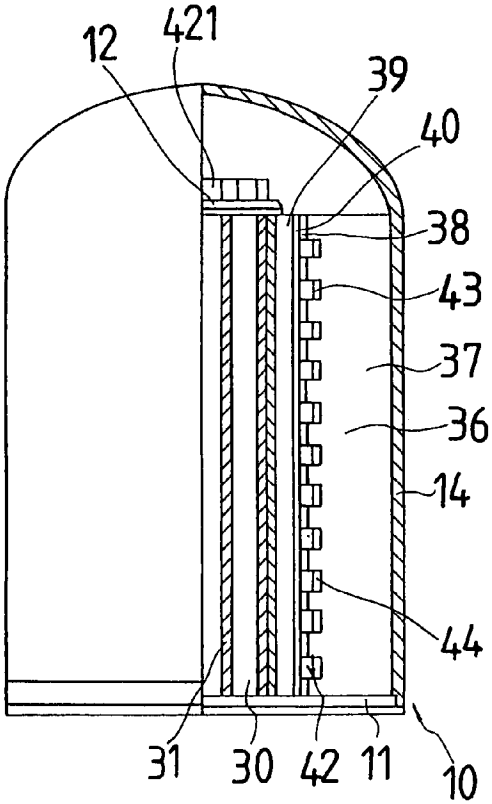
FIG. 1 is a plan view of a light device in accordance with the present invention, in which one half of the light device have been cut and shown in cross sectional structure, to show an inner structure of the light device.
Figure 3:
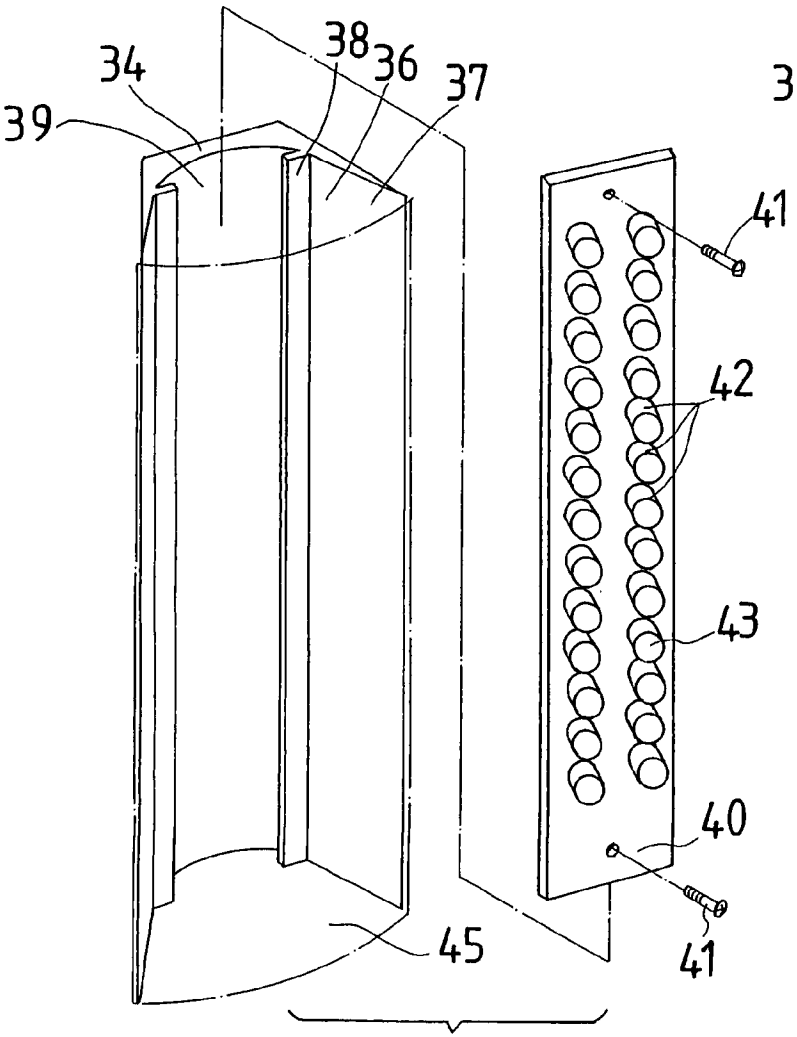
FIG. 3 is a further partial exploded view of the light device.

Referring to the drawings, and initially to FIGS. 1–3, a light device in accordance with the present invention comprises a receptacle 10 (FIG. 1) including a base panel 11, and a housing 30 disposed or secured on top of the base panel 11, with such as adhesive materials, fasteners (not shown), or the like. Alternatively, the housing 30 may also be formed integral with the base panel 11 with such as molding or mold-injection processes.

The housing 30 includes a cylindrical frame 31 having one or more flat surfaces 32 formed in the outer peripheral portion thereof (FIG. 2), and each of the flat surfaces 32 may include a slot 33, such as a dovetail slot 33 longitudinally formed therein. The housing 30 further includes one or more casings 34 selectively or changeably attached to the cylindrical frame 31, with such as adhesive materials, fasteners (not shown), or the like.

Figure 5:
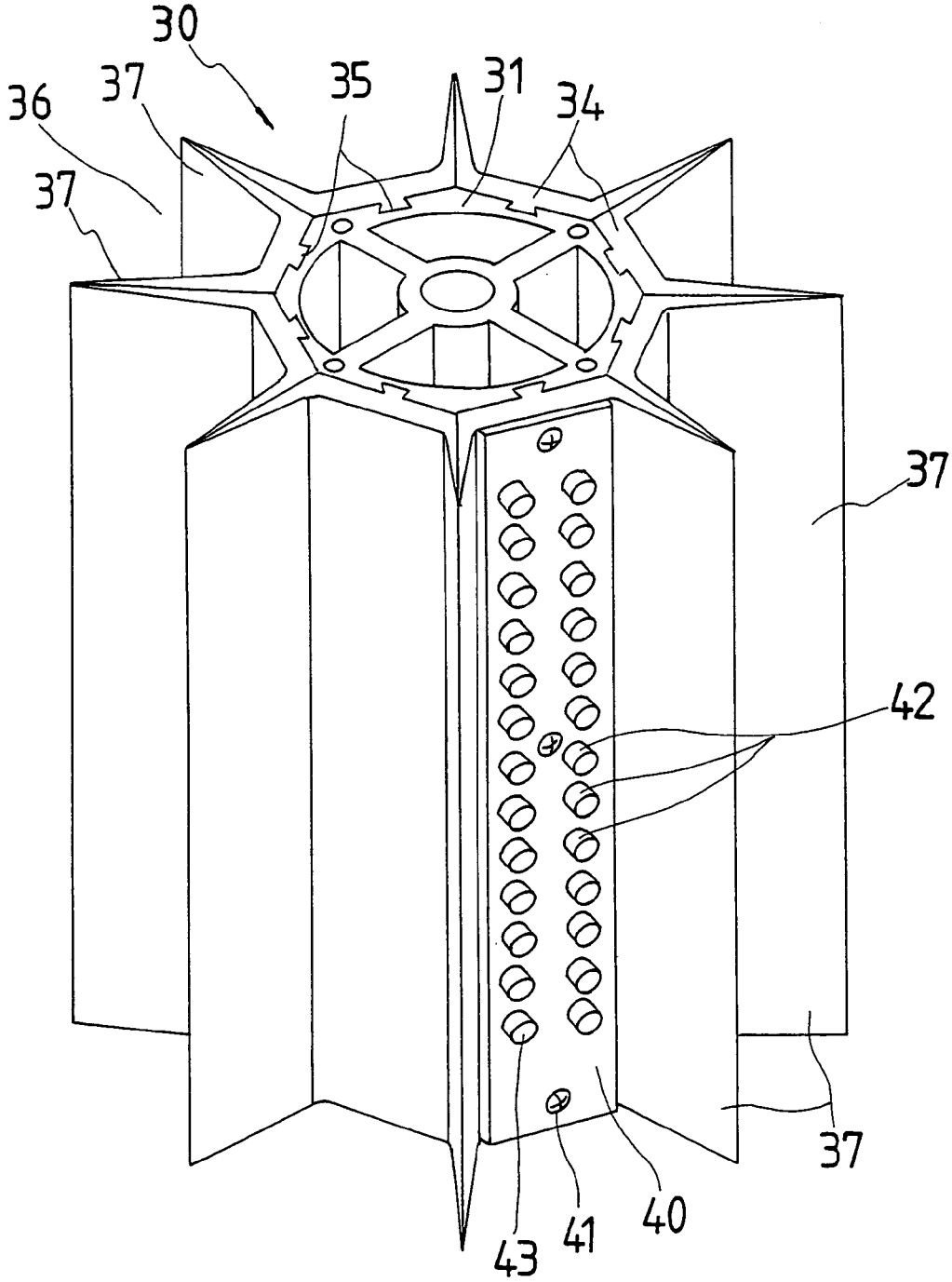
FIG. 5 is a perspective view illustrating the other arrangement of the light device.

For example, as shown in FIGS. 2 and 5, each of the casings 34 includes a key or dovetail or projection 35 extended therefrom and engageable into the corresponding dovetail slots 33 of the frame 31, to selectively or changeably attach the casings 34 to the cylindrical frame 31, with such as force-fitted engagements or the like.

Each of the casings 34 includes a chamber 36 formed therein and defined by two inclinedly and outwardly extended flaps 37, for such as light reflecting and/or concentrating purposes, and includes one or more, such as two flanges 38 extended oppositely into the chamber 36 thereof, to form or define a channel 39 therein.

Figure 4:
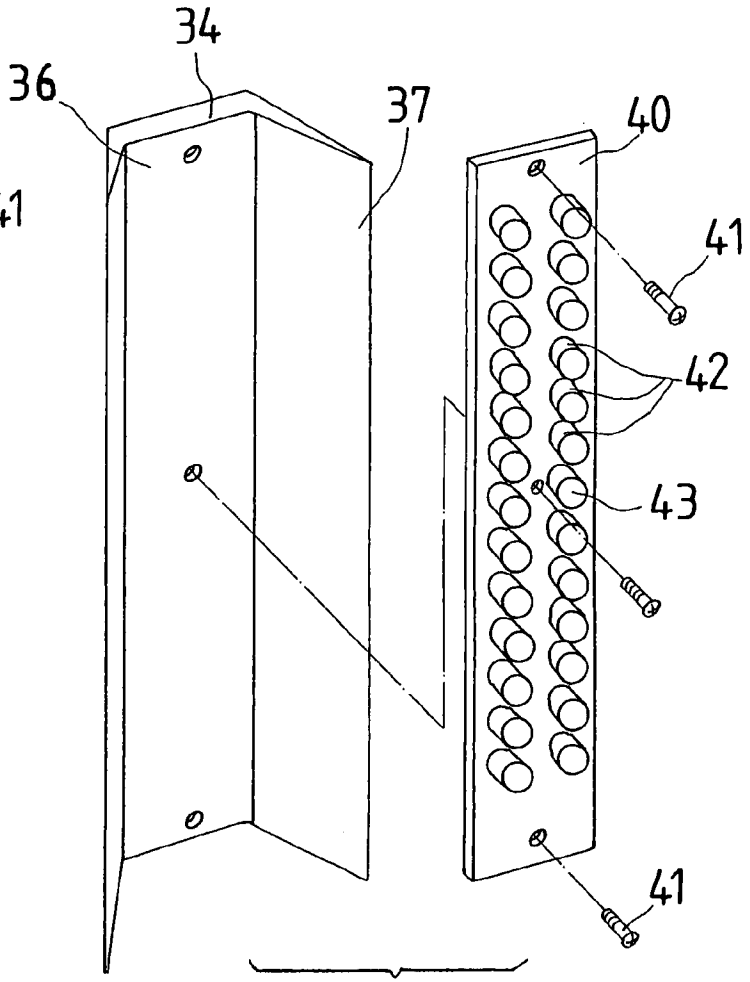
FIG. 4 is another partial exploded view of the light device.

One or more circuit boards 40 are received or engaged in the corresponding chambers 36 or channels 39 of the casings 34 or of the housing 30 and engaged with the flanges 38 respectively, to retain the circuit boards 40 in the corresponding casings 34 or in the housing 30 with such as force-fitted engagements or the like. The circuit boards 40 may also be solidly secured to the casings 34 or to the housing 30 with such as fasteners 41 (FIGS. 4, 5) which may also be used to secure the casings 34 to the housing 30.

Each of the circuit boards 40 may include a number of light members 42, such as LED light members 42 attached thereto, for generating indicating or warning lights. Each of the light members 42 may further include a head or a lens 43 attached thereon for such as light dispersing purposes. It is preferable that the light members 42 include a flat outer surface 44 formed thereon (FIGS. 1, 7), for solidly attaching the lens 43 onto the light members 42.

In operation, the light members 42 may be energized to generate indicating or warning lights when required, and the lens 43 of the light members 42 may disperse the lights. In addition, the lights may be suitably reflected and/or concentrated by the flaps 37, for allowing the light to be clearly seen by people. Furthermore, each of the circuit boards 40 may be disengaged from the casings 34 or the housing 30, for allowing the light members 42 to be changed or replaced with the other ones when required.

For example, when some of the light members 42 have been burned or damaged, the circuit boards 40 may be disengaged from the casings 34 or the housing 30, and may be changed or replaced with the other ones that have new or good light members 42 attached thereon. As shown in FIG. 3, a hood or another lens 45 may further be provided and attached to the casing 34 or the housing 30 to facilitate the lighting of the light members 42.

Figure 6:
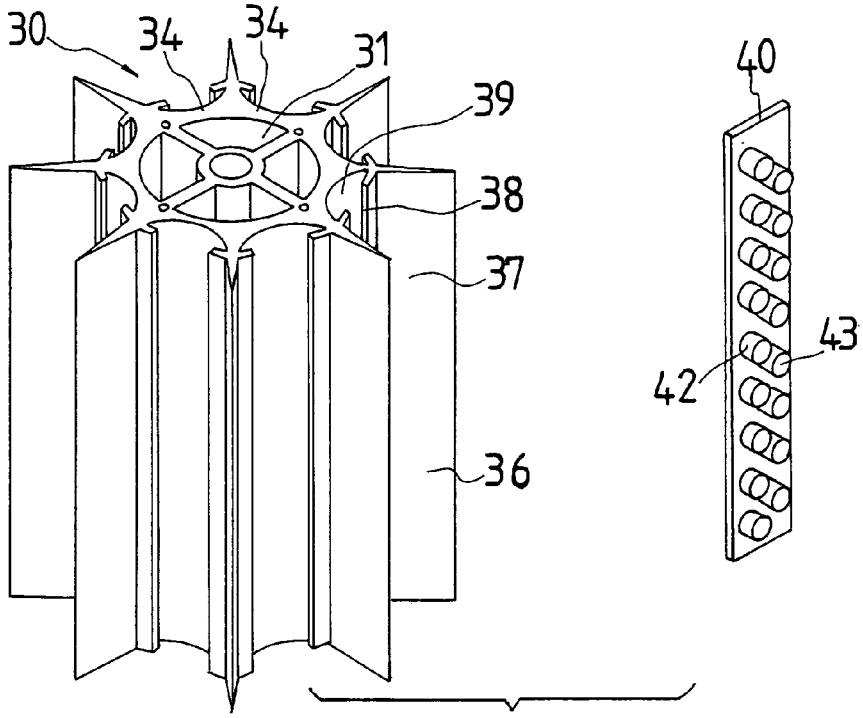
FIG. 6 is a partial exploded view illustrating the other embodiment of the light device.
Figure 7:
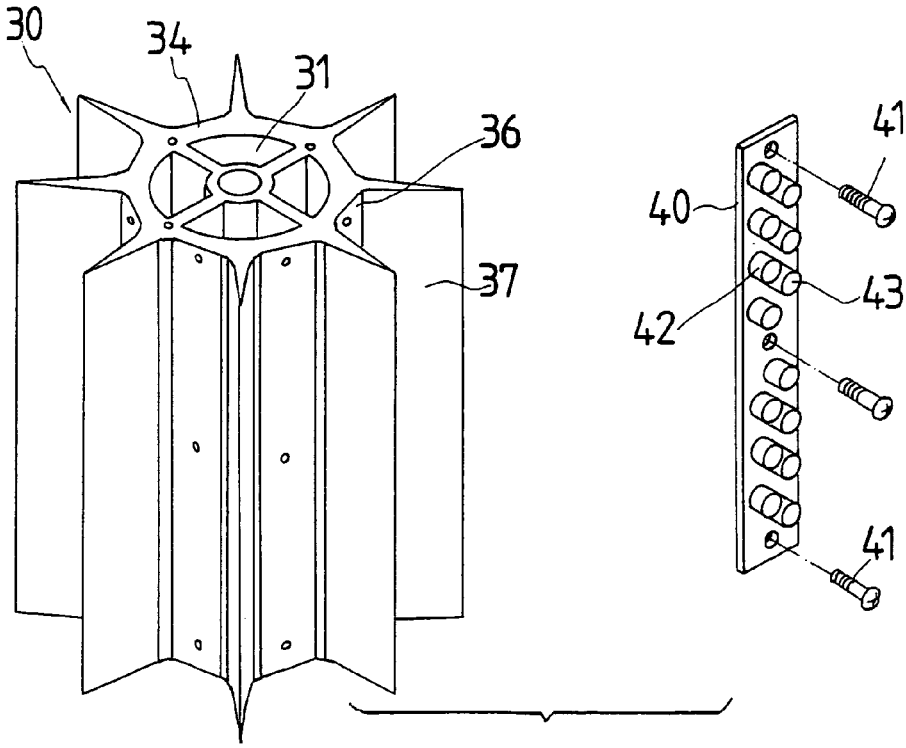
FIG. 7 is a partial exploded view illustrating the further embodiment of the light device.

Alternatively, as shown in FIGS. 6 and 7, the frame 31 and the casings 34 may also be formed as a one-integral-piece with such as molding or mold injection processes. The circuit boards 40 may be attached to the casings 34 with such as force-fitted engagements or the like and/or with the flanges 38 (FIG. 6), or may be solidly secured to the casings 34 with such as fasteners 41 (FIG. 7).

Referring again to FIG. 1, a cap 12 may further be provided and attached onto the frame 31 of the housing 30, and one or more light members 421 may further be provided and attached onto the cap 12, for emitting lights upwardly. A hood 14 or the like may further be provided and attached onto the base panel 11, for covering or shielding the light members 421.

Accordingly, the light device in accordance with the present invention includes a number of light members, such as light emitting diodes (LED) that may be easily changed or replaced with the other ones when required, and/or includes a light concentrating structure for reflecting or concentrating the lights generated by the LED light members, and/or includes a number of light members each having a head or a lens for light dispersing purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A light device comprising:

a housing including at least one chamber formed therein and defined between two flaps, and including a cap attached thereon, a receptacle including a base panel to support said housing, at least one circuit board received in said at least one chamber of said housing, and a first plurality of LED light members attached to said at least one circuit board, to emit light, a second plurality of LED light members attached to said cap to emit light, said flaps of said housing being provided to concentrate the light emitted by said first light members, and a hood attached onto said base panel, to cover and shield said housing and said first and second light members, said housing including a frame, and at least one casing secured to said frame and having said at least one chamber formed therein and having said flaps extending therefrom, said frame including a slot, said at least one casing includes a projection extending therefrom and engaged into said slot of said frame, to attach said at least one casing to said frame.

2. The light device as claimed in claim 1, wherein said housing includes at least one flange extended into said chamber thereof, to engage with and to retain said at least one circuit board in said at least one chamber of said housing.

3. The light device as claimed in claim 2, wherein said housing includes a channel formed by said at least one flange, to receive said at least one circuit board.

4. The light device as claimed in claim 1 further comprising at least one fastener engaged through said at least one circuit board, to secure said at least one circuit board to said at least one casing.

5. The light device as claimed in claim 1, wherein each of said light members includes a lens attached thereon.

6. The light device as claimed in claim 1, wherein each of said light members includes a flat outer surface formed thereon.

7. The light device as claimed in claim 1 further comprising at least one fastener engaged through said at least one circuit board, to secure said at least one circuit board to said housing.

* * * * *